United States Patent [19]

Matsuoka

[11] Patent Number: 4,846,713

[45] Date of Patent: Jul. 11, 1989

[54] CARD CONNECTOR

[75] Inventor: Noriyuki Matsuoka, Tokyo, Japan

[73] Assignee: Yamaichi Electric Mfg. Co., Ltd., Tokyo, Japan

[21] Appl. No.: 138,085

[22] Filed: Dec. 28, 1987

[30] Foreign Application Priority Data

Dec. 28, 1986 [JP] Japan ..... 61-315830

[51] Int. Cl.[4] ..... H01R 13/15

[52] U.S. Cl. ..... 439/260; 439/267

[58] Field of Search ..... 439/259, 260, 262–269

[56] References Cited

U.S. PATENT DOCUMENTS 4,540,228 9/1985 Steele ..... 439/260 X
4,626,056 12/1986 Andrews, Jr. et al. ..... 439/260
4,629,270 12/1986 Andrews, Jr. et al. ..... 439/260
4,743,203 5/1988 Grabbe ..... 439/260

FOREIGN PATENT DOCUMENTS 151253 8/1985 European Pat. Off. ..... 439/259

*Primary Examiner*—David Pirlot
*Attorney, Agent, or Firm*—Wenderoth, Lind & Ponack

[57] ABSTRACT

A card connector has a connector main body including therein a first cam block extending along the card-receiving inserting slit and capable of a first horizontal movement and also a second cam block extending along the inserting slit and in parallel relation with the first cam block. The second and first cam blocks cause the second cam block to move in a second horizontal direction by one directional first horizontal movement of the first cam block, and are brought to be in cam engagement by a first cam surface for causing the second cam block to move in the second horizontal direction by a first half movement of the first horizontal movement in the other direction. The second and first cam blocks are brought to be in cam engagement by a second cam surface for causing the second cam block to move in the vertical direction by a latter half movement of the horizontal movement in the other direction. In addition, the second cam block urgingly presses the contact to bring it to be in an opening state by the second horizontal movement and removes the pressure the contact so as to bring it to be in a closed state. Furthermore, the vertical movement causes the card to be pushed up to slide and rub the contacting surface for ensuring a good contact.

4 Claims, 9 Drawing Sheets

CARD CONNECTOR

BACKGROUND OF THE INVENTION

1. Field of the Invention

This invention relates to a card connector and more particularly to a novel mechanism for inserting a card without any load and, after insertion, allowing the contacting surface thereof to slide contact.

The term "card" used herein means a wiring board or an IC card, etc. which has a plurality of contact pieces for contacting with a plurality of contacts provided on a connector main body.

2. Brief Description of the Prior Art

Heretofore, there has been known a conventional card connector, in which a slit formed in a connector for inserting a card therethrough is provided at a bottom portion thereof with a vertically movable cam member for opening/closing a contact, the cam member being vertically moved by suitable means such as an eccentric cam member or a crank lever, the upward movement of the vertically movable cam member pressurizing and opening the contact thereby to allow the card to be inserted without any load, the downward movement of the vertically movable cam member canceling the pressure against the contact to close the contact.

However, the function of the cam member employed in the above-mentioned prior art is only to open or close the contact normally to abut a card contacting piece against a predetermined position or separate the card contacting piece threrefrom. In other words, the cam member employed in the prior art does not have such a function as to slide contact the contacting piece. The contact is always effected in the form of a mere abutment by resilient force of the contact. Therefore, good contact is prevented owing to the presence of an oxide film.

The cam member, after closing the contact, is lowered to a waiting position and allowed to be in a playing state. This means that the cam member does not have such a function as to support the card in a contacting position and to maintain the contact.

SUMMARY OF THE INVENTION

It is therefore an object of the present invention to provide a card connector, in which a card is slide contacted with a contact even after a contact is closed and the card is supported by suitable means after the slide contact is finished.

Another object of the present invention is to provide a card connector, in which a card is not accidentally moved by an external force when it is slide contacted with a contact.

A further object of the present invention is to provide a card connector, in which a contact is opened or closed while being held in a predetermined position.

To achieve the above objects, there is essentially provided a card connector, in which a card is inserted into an inserting slit formed in a main body thereof and a contact juxtaposed within the inserting slit is resiliently contacted with a contacting piece juxtaposed at a card inserting portion, characterized in that the connector main body includes therein a first cam block laid along the inserting slit and capable of a first horizontal movement in the laying direction and also a second cam block laid along the inserting slit and in parallel relation with the first cam block, the second and first cam blocks cause the second cam block to move in a second horizontal direction approaching to the contact by one directional first horizontal movement of the first cam block, and are brought to be in cam engagement by a first cam surface for causing the second cam block to move in the second horizontal direction departing from the contact by a first half movement of the first horizontal movement in the other direction, furthermore, the second and first cam blocks are brought to be in cam engagement by a second cam surface for causing the second cam block to move in the vertical direction parallel to the card inserting direction by a latter half movement of the horizontal movement in the other direction, the second cam block urgedly presses the contact to bring it to be in an opening state (s separating state from the card contacting piece) by the second horizontal movement approaching to the contact and removes the pressure onto the contact so as to bring it to be in a closing state (a contacting state of the card contacting piece with the contact), and the vertical movement causes the card to be pushed up to slide and rub the contacting surface.

According to the present invention, the first and the second cam blocks are combined in the manner as stated above, the second cam block is moved in one direction in the second horizontal direction by one directional first horizontal movement of the first cam block to form an opening state of the contact, a closing state of the contact is formed by the first half movement of the first horizontal movement of the first cam block in the other direction, and the card contacting piece is caused to slide and rub the contact by the latter half movement thereof, in sequence. Furthermore, a sequence of such action as one directional first horizontal movement of the first cam block, formation of the opening state of the contact (formation of a no-load inserting state of the card), first horizontal movement of the first cam block in the other direction, formation of the closing state of the contact (formation of a contacting state of the card contacting piece with the contact), and pushing-up and support of the card (slide friction of the contacting surface of the card contacting piece and contact, and support of the card after the completion of the slide friction), can be continuously performed without fail by a combination of the first and the second cam blocks.

Still other objects and advantages of the present invention will become readily apparent to those skilled in the art from the following detailed description, wherein only the preferred embodiment of the invention is described, simply by way of illustration of the best mode for carrying out the present invention. As will be realized, the present invention is capable of other and different embodiments, and its several details are capable of other and different embodiments, and its several details are capable of modification in various obvious respects without departing from the spirit of the present invention. Accordingly the drawings and description are to be regarded as illustrative in nature, and not as restrictive.

DETAILED DESCRIPTION OF THE PREFERRED EMBODIMENTS

Figure 1:
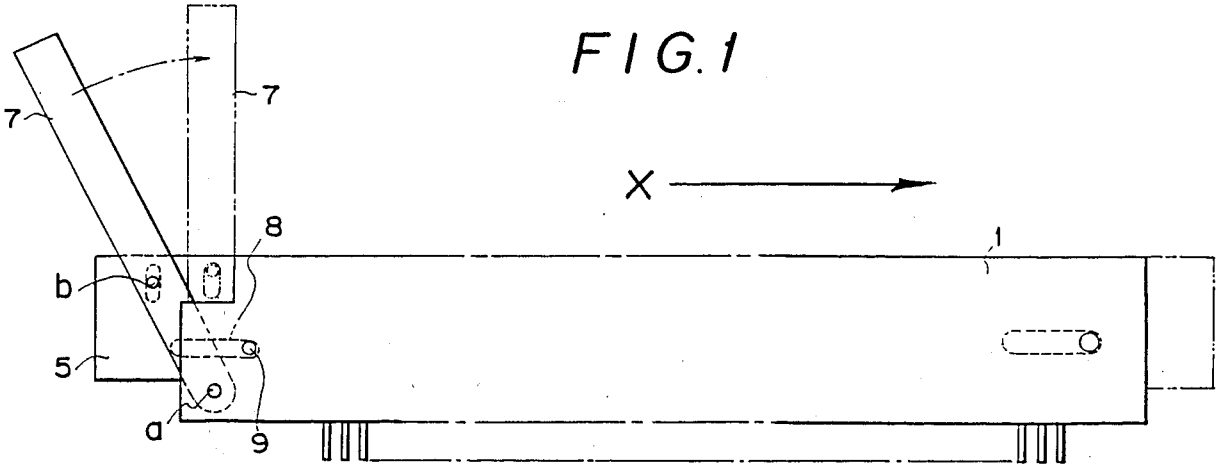
FIG. 1 is a side view showing the outer appearance of a card connector according to one preferred embodiment of the present invention.
Figure 2:
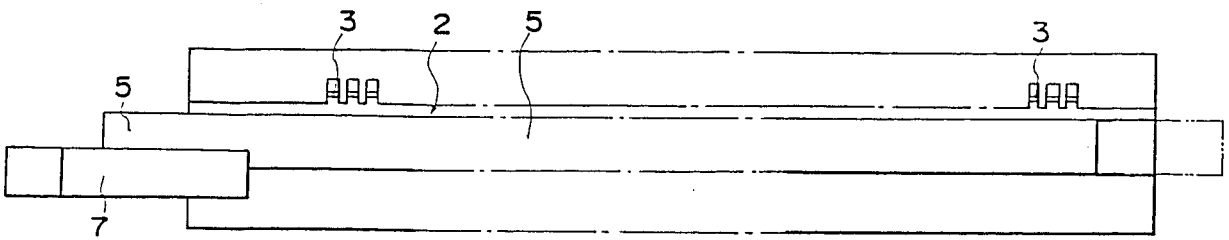
FIG. 2 is a plan view thereof.

One preferred embodiment of the present invention will be described hereunder with reference to the accompanying drawings.

In the figures, 1 denotes a card connector main body comprising an elongated insulation block. The card connector main body 1 is provided with a card insertion slit 2. The card connector main body 1 has a plurality of contacts 3 disposed in juxtaposed relation along one side surface thereof and in the elongated direction within the card insertion slit 2. Each of the contacts 3 is of a single contacting piece structure. When a card 4 is inserted into a card insertion slit 2, the contact 3 is resiliently contacted with a contacting piece disposed to a side surface of an inserting portion of the card 4 in the elongated direction.

The card connector main body 1 contains therein a combination body comprising a combination of a first cam block 5 and a second cam block 6.

As one example, the first cam block 5 shows a groove shaped channel as illustrated, whereas the second cam block 6 shows a square rod shape as illustrated. The second cam block 6 is fitted in a groove of the first cam block 5. The first cam block is laid along the card insertion slit 2 (contact juxtaposing row) so that the groove is faced with the contacts 3, and is horizontally movably contained within the connector main body 1 for moving in the laying direction.

Similarly, the second cam block 6, when fitted in the groove of the first cam block 5 as mentioned, is laid along the card insertion slit 2 so that an inner side surface in the elongated direction thereof is exposed from an opening portion of the groove of the first cam block 5 and in such a manner as to be faced with the contacts 3.

The first cam block 5 aligns an external side vertical surface **5*a* thereof and a bottom portion external side horizontal surface 5*b* perpendicular to the external vertical surface 5*a* with an inner wall surface of a cam block fitting portion of the connector main body 1**, and guides the aforementioned horizontal movement.

Further, the first cam block is provided at an upper portion thereof with an inserting slit defining portion **5*c* for forming one side wall of the card inserting slit 2. Furthermore, the first cam block 5 includes an inner vertical surface 5*d* defining a fitting groove of the second cam block 6, and a bottom inner horizontal surface 5*e* perpendicular to the inner vertical surface 5*d***.

On the other hand, the second cam block 6 includes an outer vertical surface **6*a* parallelly opposite to the inner vertical surface 5*d* defining the groove of the first cam block 1, and a bottom horizontal surface 6*b* parallelly opposite to the bottom inner horizontal surface 5*e* defining the groove of the first cam block 1**.

In the above-mentioned state, a card supporting surface as a bottom wall of the card inserting slit 2 is formed by an upper horizontal surface **6*c* of the second cam block, and the inner vertical surface 6*d* is disposed in such a manner as to be opposite to the contact 3** juxtaposed with each other as mentioned above.

The respective surfaces of the inner vertical surface **5*d* of the first cam block 5 and the outer vertical surface 6*a* of the second cam block 6** form a first cam surface A.

Similarly, the respective surfaces of the bottom inner horizontal surface **5*e* of the first cam block 5 and the bottom horizontal surface 6*b* of the second cam block 6 form a second cam surface B. The first cam block 5 is moved parallel to and along the inner walls of the main body 1 defining the card insertion slit 2 and, during the movement of the first cam block 5, the surfaces of the first and second cam blocks 5 and 6 constituting the first cam surface A are kept in a face-to-face relation and the surfaces of the first and second cam blocks 5 and 6** constituting the second cam surface B are also kept in a face-to-face relation.

Figure 4A:
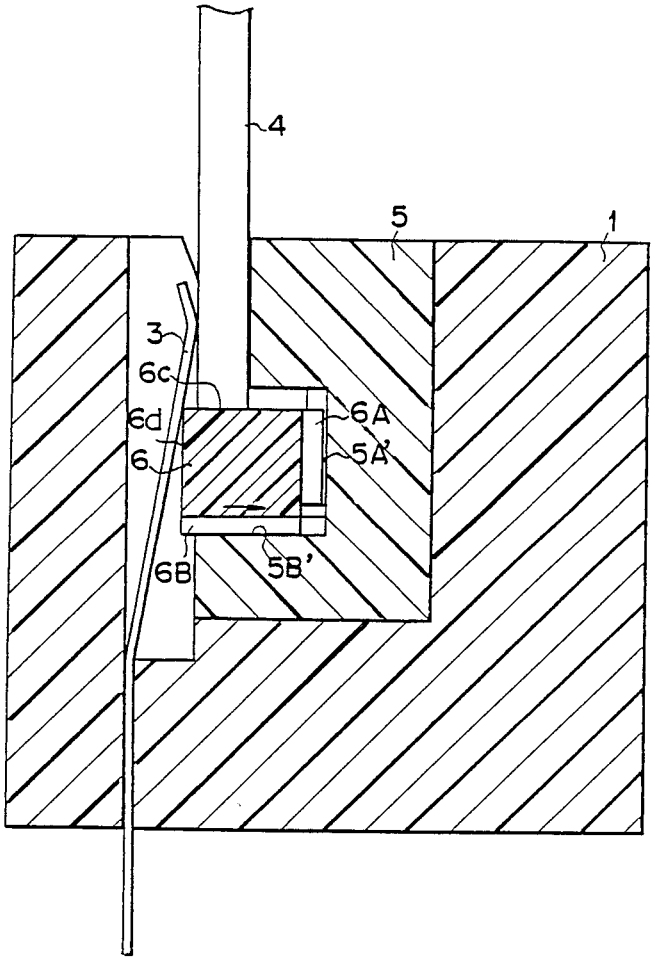
FIG. 4(A) is a sectional view of a connector which is closed by moving a second cam block in the other direction in the second horizontal direction by a first half movement of a first horizontal movement of a first cam block in the other direction to the respective directions shown in FIG. 3(A)
Figure 5A:
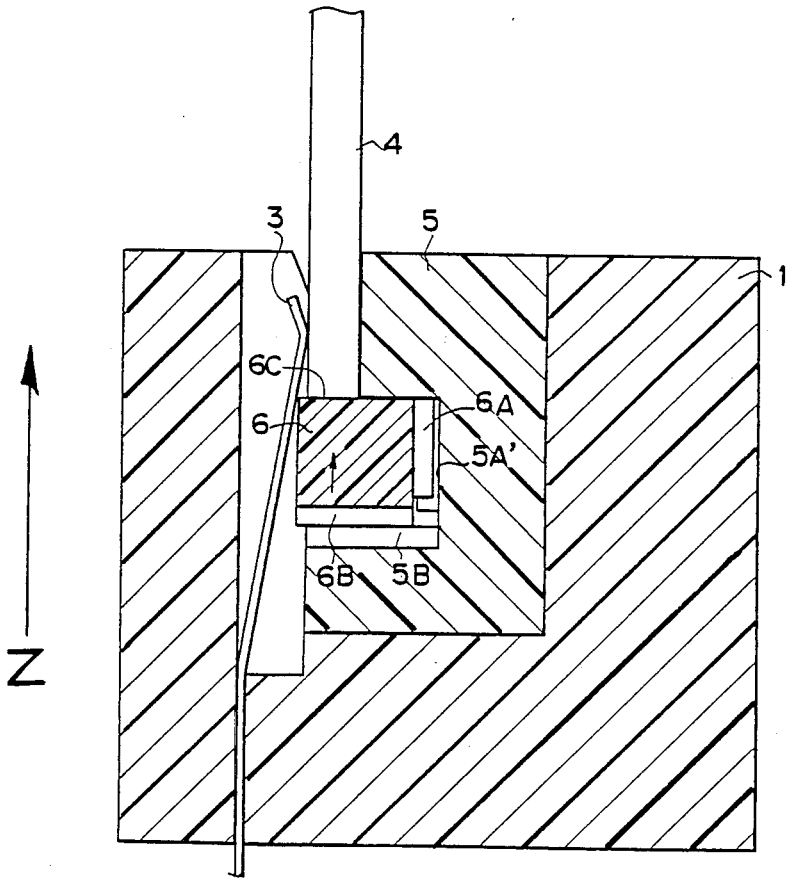
FIG. 5(A) is a sectional view of the connector slide contacting with the slide contacting surface of the card pushed up by a vertical movement of the second cam block by a latter half movement of a first horizontal movement of the first cam block in the other direction.
Figure 5B:
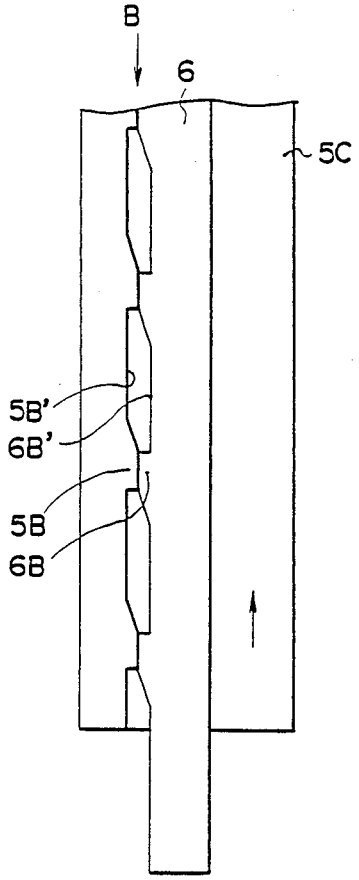
FIG. 5(B) is a plan view of the first and the second cam blocks showing the engaging state between the hill and valley on the second flat cam surface under the state of FIG. 5(A)
Figure 5C:
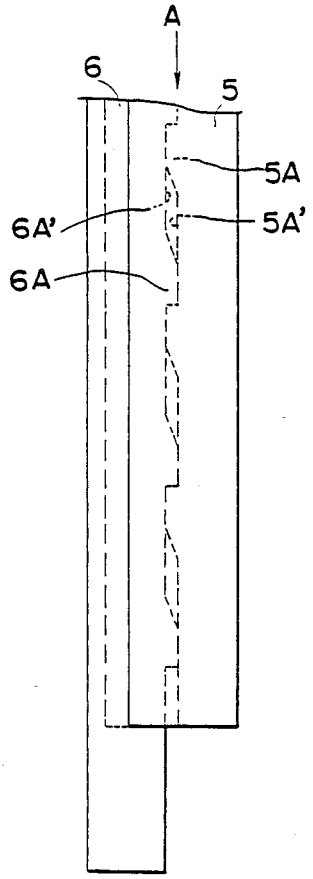
FIG. 5(C) is a front view thereof showing the engaging state between the hill and valley on the first flat cam surface under the state of FIG. 5(A)
Figure 6A:
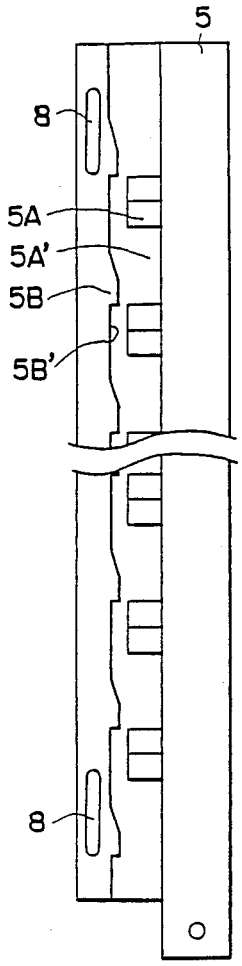
FIG. 6(A) is a front view of the first cam block.
Figure 6B:
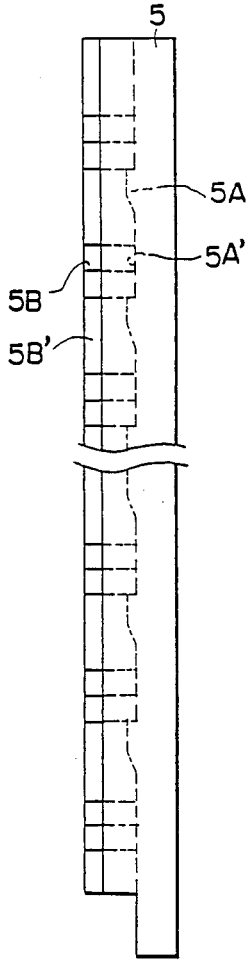
FIG. 6(B) is a plan view thereof.
Figure 6C:
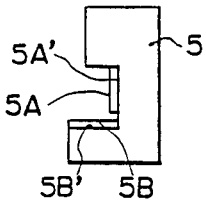
FIG. 6(C) is a side view thereof
Figure 7A:
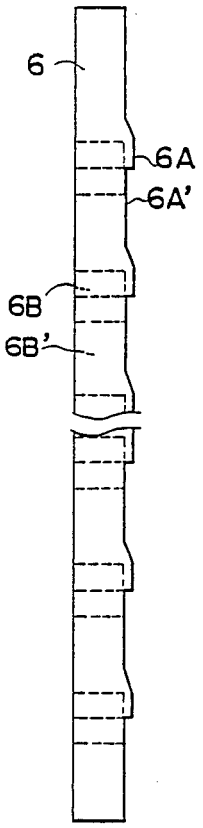
FIG. 7(A) is a plan view of the second cam block.
Figure 7B:
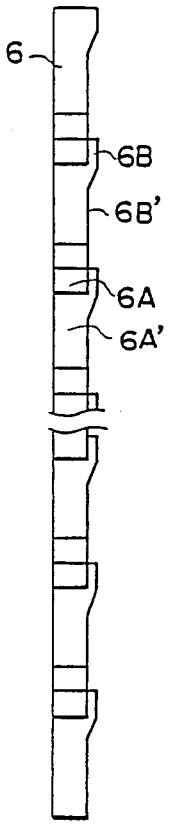
FIG. 7(B) is a rear view thereof.
Figure 7C:
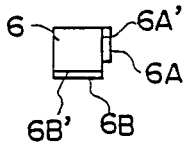
FIG. 7(C) is a side view thereof.

The first and the second cam surfaces A and B are formed by hills and valleys periodically formed on the respective opposing surfaces of the first and the second cam blocks 5 and 6, and formed, as shown in FIGS. 6 and 7, by providing a predetermined phase difference between a cam pitch of the first cam surface A and that of the second cam surface B according to a premise which will be described hereinafter. This will be explained with reference to FIGS. 3 through 5.

As described in the foregoing, the first cam block 5 can move in the first horizontal direction (movement in the X-axis direction). The first horizontal movement thereof in one direction causes the second cam block 6 to move in a second horizontal direction (one directional movement in the Y-axis direction) in one direction owing to the function of the first cam surface A to urgingly press the contact 3 to form an opening state (separating state from the card contacting piece) thereof (the state shown in FIG. 3). In that state, the card 4 can be inserted without any load. The card 4 inserted without a load, is supported on an end face thereof by the upper horizontal surface 6c of the second cam block 6. Also, by means of a first half movement of the first horizontal moving operation of the first cam block 5 in the other direction, the second cam block 6 is moved in the other direction in the second horizontal direction Y-axis movement in the other direction) owing to the function of the first cam surface A, thereby to release the pressure onto the contact 3 and to form a closing state (contacting state with the card contacting piece) (the state of FIG. 4(A)).

Furthermore, by a latter half horizontally moving operation of the first cam block 5 in the other direction, the second cam block 6 is vertically moved upwards (movement in the Z-axis direction), thereby to move the card 4 upwards by the upper horizontal surface 6c and slide and rub the above-mentioned contacting surface, and the supporting state of the end face of the card 4 is maintained at the upper extreme (the state shown in FIG. 5(A)). The contacting piece and the contact are cleaned by this slide friction so as to obtain a good contact by an active surface from where an oxide film is removed.

As means for horizontally moving operation of the first cam block 5, as shown in FIG. 1, a lever 7 is pivotably supported by one end of the connector main body 1 for pivoting about a fixed supporting point a, and the lever 7 is pivotably supported by one end of the first cam block 5 for pivoting about a playing supporting point b. Also, the first cam block 5 and connector main body 1 are guided in the first horizontal movement thereof by means of snug fit of a pin 9 into an elongated hole 8 formed in the first horizontal movement direction.

Figure 3A:
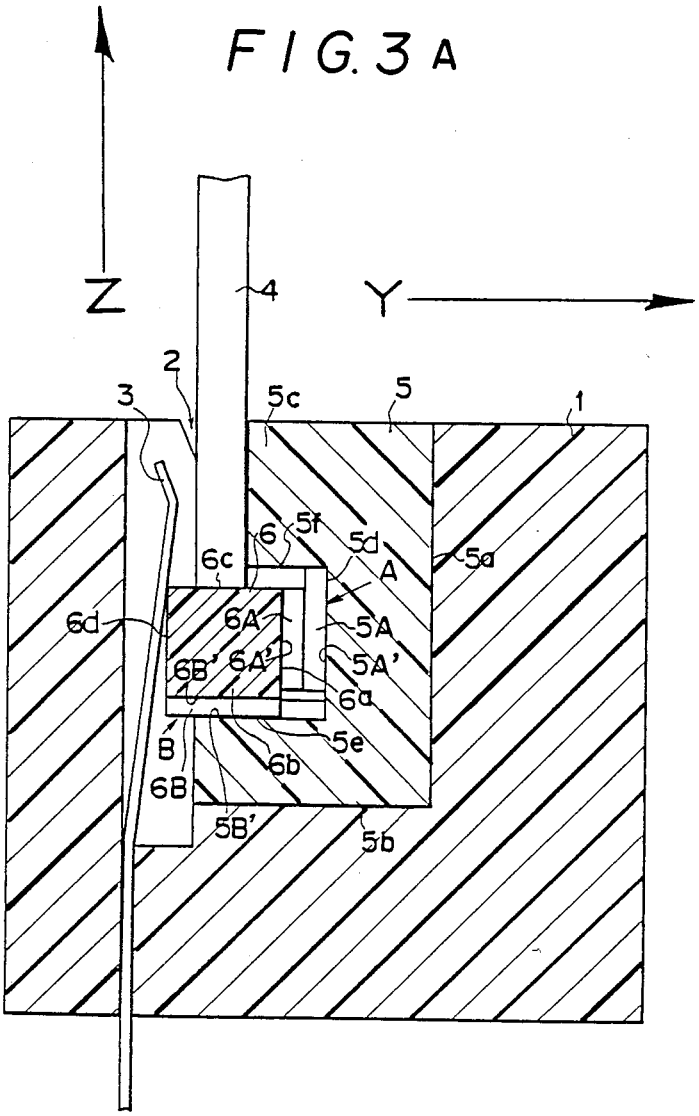
FIG. 3(A) is a sectional view of the connector of FIG. 1 but when a contact thereof is opened by moving a second cam block in one direction in a second horizontal direction by moving a first cam block in one-direction in a first horizontal direction.
Figure 3B:
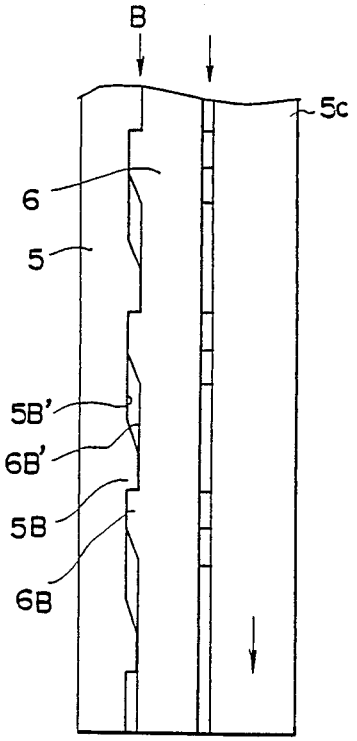
FIG. 3(B) is a plan view of the first and the second cam blocks in the above-mentioned state, showing the engaging state between the hill and valley on a second cam surface.
Figure 3C:
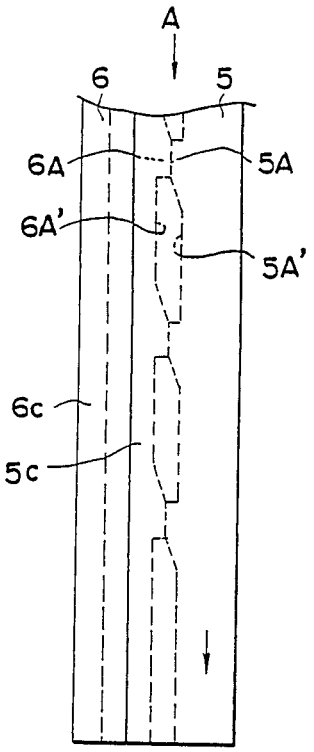
FIG. 3(C) is a front view thereof but showing the engaging state between the hill and valley on a first cam surface.

That is, the first cam block 5 is horizontally moved in one direction by one directional pivotal movement of the lever 7 and, as is shown in FIG. 3, the hill 6A of the second cam block 6 and the hill 5A of the first cam block 5 are brought to be opposite with each other at the first cam surface A (at this time, the hill 6B of the second cam block 6 is in opposite with the valley 5B' of the first cam block 5 at the second cam surface B), and the contact 3 is urgedly pressed by the upper angular portion of the inner vertical surface 6d of the second cam block 6 to form the afore-mentioned open state, thereby to enable a no load insertion of the card 4.

Figure 4B:
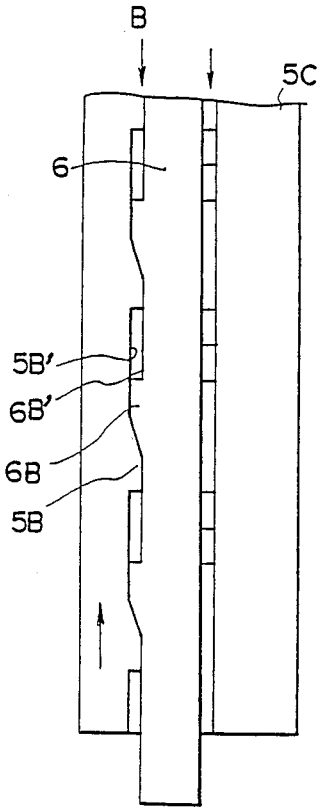
FIG. 4(B) is a plan view of the first and the second cam blocks showing the engaging state between the hill and valley on a second flat cam surface under the state of FIG. 4(A)
Figure 4C:
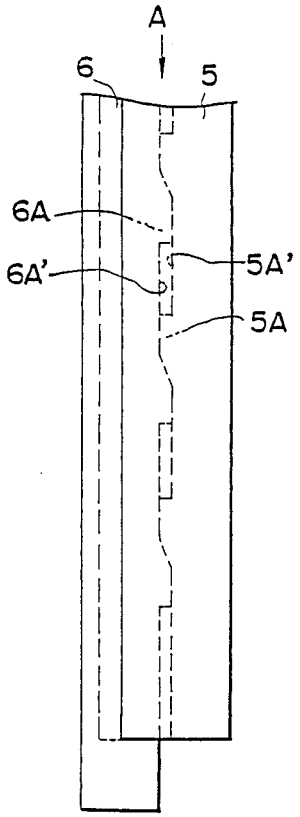
FIG. 4(C) is a front view thereof showing the engaging state between the hill and valley on the first flat cam surface under the state of FIG. 4(A)

If the first cam block 5 is horizontally moved in the other direction by pivotally moving the lever 7 in the other direction, as is shown in FIG. 4, the valley 5A' of the first cam block 5 and the hill 6A of the second cam block 6 are brought to be opposite with each other at the first cam surface A by the first half movement of the first horizontal movement of the first cam block 5 (at this time, the state of FIG. 3 is maintained at the second cam surface B, wherein the valley 5B' of the first cam block 5 and the hill 6B' of the second cam block 6 are opposite with each other). As a result, the second cam block 6 is moved in the backward direction in the second horizontal direction to release the pressure of the contact 3 and form a contacting state with the card.

Succeedingly, if the lever 7 is pivotally moved in the other direction to transfer the first cam block 5 into the latter half movement of the first horizontal movement in the other direction, as is shown in FIG. 5, the state of FIG. 4 is maintained at the first cam surface A, whereas the hill 5B of the first cam block 5 ad the hill 6B of the second cam block 6 are brought to be opposite with each other at the second cam surface B, there by to move the first cam block 5 upwards in the vertical direction. As a result, the card 4 is pushed up by the upper horizontal surface 6c of the first cam block 6 to slide and rub the card contacting piece and the contact 3 at the afore-mentioned contacting surface, thereby to enable a contact on a wholesome surface.

When the card is to be withdrawn, by horizontally moving back from the state of FIG. 5 to the state of FIG. 3, the second cam block 6 is lowered by its own weight during the first half movement of the first horizontal movement, and the contact 3 is urgedly pressed by the latter half movement of the first horizontal movement so that it is brought to be in the state of FIG. 3. As a result, the card 4 can be withdrawn without any load.

Figure 8:
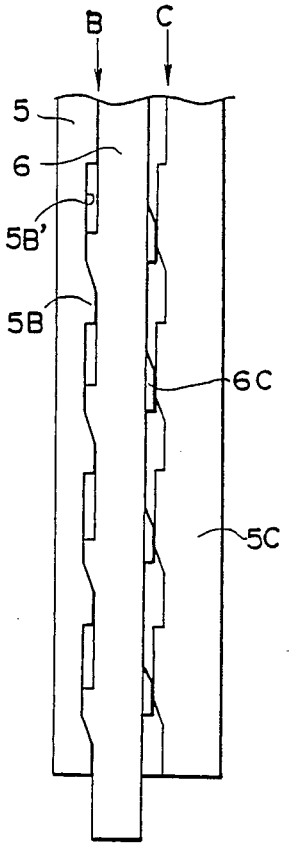
FIG. 8 is a front view of a first and a second cam block according to a modified embodiment, in which a modified cam mechanism for moving the second cam block in the vertical direction is shown.

As another embodiment as shown in FIG. 8, an upper inner horizontal surface 5f opposite to a bottom inner horizontal surface 5e of the first cam block 5 and the upper horizontal surface 6c opposite to the bottom horizontal surface 6b of the second cam block 6 are brought to be opposite with each other, and on the opposing surface thereof, a third cam surface C is formed, wherein the arrangement of the hill and the valley is completely reverse with respect to the second flat cam surface, and the second cam block 6 is moved in the vertical direction while being held between the second and the third cam surfaces B and C.

As described in the foregoing, according to the present invention, the first cam block and the second cam block are so combined as mentioned above, the second cam block is moved in one direction in the second horizontal direction by one directional horizontal movement of the first cam block to form an opening state of the contact, a closing state of the contact is formed by a first half movement of the first horizontal movement of the first cam block in the other direction, and the sliding and rubbing action between the card contacting piece and the contact is performed in turn by the latter half movement of the first horizontal movement thereof. The first cam block is one directionally horizontally moved, then an opening state of the contact is formed (formation of a no-load insertion state of the card), then the first cam block is horizontally moved in the other direction, a closing state of the contact is formed by the first half movement of the first horizontal movement thereof (a contacting state is formed between the card contacting piece and the contact), and a pushing and supporting state of the card (slide friction of the contacting surface between the card contacting piece and the contact and support of the card after the completion of the slide friction) is formed by the latter half movement of the first horizontal movement thereof. This sequence of action is correctly and without fail performed by the afore-mentioned combination between the first and the second cam blocks.

Further, the first and the second cam blocks, while pushing up the card and obtaining a slide friction state by the above-mentioned action, can form a supporting state of the card at the upper extreme, the card can be maintained in its contacting state at a predetermined position, and an invitation of a contact defect caused by accidental movement of the card by an external force can be favorably prevented.

Furthermore, although the first cam block is horizontally moved, the second cam block is not horizontally moved in the same direction. Instead it is moved in the second horizontal direction in such a manner as to be pushed against a front surface of the contact so that the contact is opened or closed. Accordingly, no such inconvenience is invited as that an unbalanced load is incurred to the contact to displace as in the case, for example, where the cam member is horizontally moved or slantly moved by contacting the contact. Thus, the contact can be opened and closed while being held in a proper position.

The card connector according to the present invention has heretofore been explained in detail with reference to the illustrative and preferred embodiments. However, it is not intended to restrict the scope of the present invention to those specific embodiments as set forth above, as already mentioned.

What is claimed is:

1. A card connector comprising:

a main body having a card insertion slit for receiving a card therein;

at least one resilient contacting piece attached to said main body and adjacent to said insertion slit, and each said at least one contacting piece having a contact surface means for normally contacting a card when a card is received in said insertion slit and for rubbing a card when a card is received in said insertion slit and is moved relative to said contact surface means when said at least one contacting piece is in its normally closed position;

a first cam block reciprocably slidably received in said main body and adjacent to said insertion slit for reciprocating in a first horizontal direction, and a first and a second cam surface on said first cam block for engaging a first and a second cam surface on a second cam block; and a second cam block reciprocably slidably received in said main body adjacent to said insertion slit, adjacent to said at least one resilient contacting piece, and adjacent to said first cam block for reciprocating in a second horizontal direction and for reciprocating in a vertical direction, a first and a second cam surface on said second cam block for engaging said first and said second cam surface of said first cam block, said first cam surface of said second cam block being engaged by said first cam surface of said first cam block for moving said second cam block forwardly in the second horizontal direction for causing said at least one contacting piece to move away from its normally closed position to an open position for receiving a card in said insertion slit when said first cam block is moved forwardly in the first horizontal direction from an initial position, said first cam surface of said second cam block being engaged by said first cam surface of said first cam block and causing said second cam block to move rearwardly in the second horizontal direction for causing said at least one contacting piece to move back to its normally closed position for engaging a card when a card is received in said insertion slit and said first cam block is moved rearwardly in the first horizontal direction toward its initial position, and said second cam surface of said second cam block being engaged by said second cam surface of said first cam block for moving said second cam block upwardly in the vertical direction for engaging and moving a card received in said insertion slit for rubbing a card against said contact surface means of said at least one contacting piece when said at least one contacting piece is in its normally closed position and when a card is received in said insertion slit and said first cam block is moved further rearwardly in the first horizontal direction past its initial position.

2. A card connector as in claim 1, further comprising means attached to said main body for moving said first cam block in the forward and rearward first horizontal directions.

3. A card connector as in claim 1, wherein said first cam block has a substantially rectangular groove, said second cam block has a substantially rectangular rod-like shape, said second cam block is slidably received in said substantially rectangular groove of said first cam block, an inner vertical surface for partially defining said groove of said first cam block and an outer vertical surface of said second cam block are in spaced opposed relation to each other, said first cam surface of said first and second cam blocks are substantially defined by said inner vertical surface and said outer vertical surface, and a bottom inner horizontal surface for partially defining said groove of said first cam block and a bottom horizontal surface of said second cam block are in spaced opposed relation to each other, and said second cam surfaces of said first and second cam blocks are substantially defined by said bottom inner horizontal surface and said bottom horizontal surface.

4. A card connector as in claim 3, wherein an upper inner horizontal surface for partially defining said groove of said first cam block and an upper horizontal surface of said second cam block are spaced opposed to each other, and a third cam surface for acting concurrently with said second cam surfaces of said first and second cam blocks for moving said second cam block in the vertical direction when said first cam block is moved in the first direction is substantially defined by said upper inner horizontal surface and said upper horizontal surface.

* * * * *